US008300820B2

(12) United States Patent
Rhein

(10) Patent No.: US 8,300,820 B2
(45) Date of Patent: Oct. 30, 2012

(54) METHOD OF EMBEDDING A DIGITAL WATERMARK IN A USEFUL SIGNAL

(75) Inventor: Hanspeter Rhein, Wedemark (DE)

(73) Assignee: Unlimited Media GmbH, Wedemark (DE)

( * ) Notice: Subject to any disclaimer, the term of this patent is extended or adjusted under 35 U.S.C. 154(b) by 1227 days.

(21) Appl. No.: 11/814,296

(22) PCT Filed: Jan. 16, 2006

(86) PCT No.: PCT/EP2006/000330

§ 371 (c)(1),
(2), (4) Date: Jan. 24, 2008

(87) PCT Pub. No.: WO2006/077061

PCT Pub. Date: Jul. 27, 2006

(65) Prior Publication Data

US 2008/0209219 A1 Aug. 28, 2008

(30) Foreign Application Priority Data

Jan. 21, 2005 (EP) ..... 05001222

(51) Int. Cl.
*H04K 1/02* (2006.01)

(52) U.S. Cl. ..... 380/252; 713/176; 713/177; 713/180; 704/500

(58) Field of Classification Search ..... 380/252; 713/176; 704/500

See application file for complete search history.

(56) References Cited

U.S. PATENT DOCUMENTS

| | | | | |
|---|---|---|---|---|
| 7,114,072 | B2 * | 9/2006 | Seok et al. | 713/176 |
| 7,287,163 | B2 * | 10/2007 | Ogino | 713/176 |
| 7,299,189 | B1 * | 11/2007 | Sato | 704/500 |
| 2002/0078359 | A1 * | 6/2002 | Seok et al. | 713/176 |
| 2003/0194004 | A1 | 10/2003 | Srinivasan | |

FOREIGN PATENT DOCUMENTS

GB 2 292 506 A 2/1996

* cited by examiner

*Primary Examiner* — Thanhnga B Truong

(74) *Attorney, Agent, or Firm* — Fraser Clemens Martin & Miller LLC; James D. Miller

(57) ABSTRACT

Method of embedding a digital watermark in a useful signal, wherein a watermark bit sequence is embedded into the frequency domain of the useful signal using adaptive frequency modulation of two given frequencies by tracking amplitudes of the chosen frequencies of the original signal and modifying them according to the current bit of watermark bit sequence.

18 Claims, 5 Drawing Sheets

Figures 1, 2:
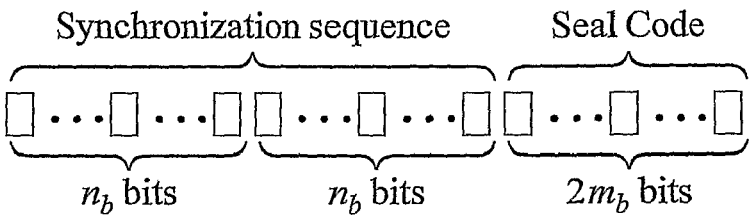

| $f_1$ | $g_1$ | $f_2$ | $g_2$ | $f_3$ | $g_3$ |
|---|---|---|---|---|---|
| 500 | 600 | 700 | 800 | 900 | 1000 |

METHOD OF EMBEDDING A DIGITAL WATERMARK IN A USEFUL SIGNAL

The invention relates to a method of embedding a digital watermark in a useful signal, in particular an audio signal, as well as to a method of detecting embedded digital watermarks and respective devices.

The term 'useful signal' as used herein is meant to designate signals which represent data intended eventually for reception by a user, in particular a human user. Common examples of useful signals are audio signals, representing the evolution of a spectrum of frequencies for acoustic waves over time (the spectrum ranging for example from 300 Hz to 3400 Hz for telephony or from 10 Hz to 20 kHz for high quality reproduction of a classical concert) or video signals (single as well as moving images), where a frequency of the useful signal is, for example for displaying on a TV or cinema screen, defined by the image properties and lies between 0 Hz (an empty image) and a maximum frequency determined by the rows and columns of the screen and a refresh rate for moving images, e.g. 6.5 MHz for many TV-systems.

Useful signals might however also include signals representing text strings or other representations and also future developments of such signals intended directly or indirectly in particular for human perception.

Useful signals might be represented in an analogous way, for example as radio or TV signals, or might be represented as digital signals, for example PCM-signals formed by sampling an analogous signal with subsequent quantizing and perhaps coding steps. In any case a useful signal is meant to include a complete representation of the relevant data set, be it a single piece of music or a set of such tracks, a single image or a complete movie.

For useful signals, there is often a need to include auxiliary data within the data set represented by the signal. Such auxiliary data might be related to an indication of authorship, the publisher, sales and distribution, etc. Such indications are particularly relevant for useful signals representing digitized data, as these can be copied any number of times without loss of quality. Here, the abovementioned indications allow proof of property rights, and enable the tracking of illegal copies, the checking of the number of legal copies and equipment, the monitoring of broadcasts, etc.

Auxiliary data as used herein might in principle relate to any kind of ancillary data to be provided along with user related data, in particular multimedia data.

The obvious method of introducing auxiliary data in a data set is to provide these data in a form that allows them to be processed in the same way as the primary data intended for the user's perception, e.g. to add a spoken information to an audio track. Auxiliary data of this kind can however be easily removed, changed or hidden from the user's perception, further, such information may perturb the perception of the primary data. Upcoming standards for the provision of multimedia data, for example developed from the MPEG (http://www.chiariglione.org/mpeg/) allow for additional associated data which will be processed in future audio/video devices without compromising the primary data, but still then the problem of malicious modification remains.

Therefore, a number of known methods provide primary data with digital watermarks. These (also occasionally called 'seal codes' hereinafter) are auxiliary data, which are embedded within or imprinted onto the primary data itself. The original primary data are thus modified. Although this might be a problem for digital data intended for processing by machines, data intended for human users might be modified in a way that the digital watermark is transparent for the user, i.e. invisible, inaudible or in general not perceptible.

A watermarking method generally comprises an embedding or imprinting part and a detection part. The embedding part uses a key to imprint a (non-perceptible) pattern to the primary data. The detector uses a corresponding key to read out the embedded watermark.

An example for a known method of providing a digital watermark in digital data is LSB-Watermarking. Here, the least significant bit ("LSB") of a byte included in a code word representing for example an intensity (e.g. gray or color scale for a pixel in an image), is modified. Although an embedded watermark of this kind might comprise a large number of bits (e.g. 256 bits), it is not perceptible, as the gray value of a pixel changes at most, For example, from an intensity value of 255 to a value of 254 for a code word of one byte length.

However, still the problem of malicious modification remains. In the above example, it is easily possible to remove the watermark, simply by setting all LSBs within the data set to '1' or '0'. The perception quality of the data is not changed noticeably in this step.

Thus, it is an object of the invention to provide a method of embedding a digital watermark in a useful signal, in particular an audio signal, wherein the watermark is transparent to human perception, is not easily removed or modified without significant modification of the primary data, and at the same time is detectable with high reliability after additional processing, transmission, storing, noise and attacks aimed at modification or removal of the watermark, as well as to provide a method of detecting imprinted digital watermarks and to provide respective devices.

This object is solved by a method of embedding a digital watermark in a useful signal with the features of claim 1, a method of detecting a digital watermark in a useful signal with the features of claim 14, as well as by computer programs with the features of claims 24, 25 and devices with the features of claims 27 and 28.

One of the fundamental ideas of the invention is to go beyond the principle of embedding the watermark, which is represented by a bit sequence, just into the sequence of bits constituting the digital primary data. Rather, the watermark bit sequence is imprinted to the useful signal itself, be it represented as digital or analogous signal.

In detail, according to the invention a method of embedding a digital watermark in a useful signal, in particular an audio signal, is proposed, wherein the useful signal represents the evolution of a spectrum comprising useful signal frequencies, for example audio frequencies, over time, and the digital watermark includes a watermark bit sequence, each bit of the watermark bit sequence representing one of a first state, for example '1', and a second state, for example '0'. For imprinting the first state on the useful signal, the ratio of a first spectral amplitude of the useful signal at a first imprinting frequency to a second spectral amplitude of the useful signal at a second imprinting frequency is established to be higher or equal to a first value of a threshold parameter. For imprinting the second state, the ratio of the second spectral amplitude of the useful signal at the second imprinting frequency to a first spectral amplitude of the useful signal at a first imprinting frequency is established to be higher or equal to a second value of the threshold parameter.

Thus, the watermark is imprinted by weak modulation of the original useful signal. The inventive method has the advantage that the watermark is reliably recovered during digital-to-analog- and/or analog-to-digital-conversion, thus preventing for example respective trials to maliciously remove the watermark. The watermarks can further be made resistant to sound processing (echo, effects, amplitude or frequency changes . . . ) and digital compression and format changes.

Preferably, for imprinting the first state, the correspondent ratio is adjusted by decreasing the second spectral amplitude, and for imprinting the second state, the corresponding ratio is adjusted by decreasing the first spectral amplitude. This contributes to the watermark being transparent for human perception. In case the ratio to be established for either one of the states is already represented in the original or unmodified useful signal, the useful signal is not modified. This can be achieved by the invention by specifying the ratio of spectral amplitudes as being 'larger as or equal to' each other instead of prescribing some fixed values.

In preferred embodiments of the inventive method of imprinting a digital watermark, a bit time length is established indicating a time length within which the state represented by a single bit is imprinted to the useful signal. This value can be either chosen by a user (i.e. author, distributor, seller, etc.) or a fixed value is specified by a standardization body, e.g. by the European Broadcasting Union, www.ebu.ch. In this case the value might be programmed as a constant into an imprinting device.

In these embodiments, further a segment time length is calculated, using the number of bits of the watermark bit sequence and the bit time length, which indicates the time length within which the watermark bit sequence is imprinted to the useful signal. A segment of the useful signal with a time length of at least a segment time length is selected to imprint the watermark bit sequence. This allows choosing optimal positions of the watermark in the useful signal.

In embodiments developed further, two or more non-overlapping segments are selected to imprint the watermark bit sequence two or more times to the useful signal. This allows even more reliable embedding and detecting of the watermark.

It has been found appropriate for a reliable embedding resp. detection process that the first and second value of the threshold parameter are equal. Further, useful values of the threshold parameter are between 1 and 10. Such values provide on the one hand for a reliable masking, on the other hand for reliable detection of the watermark signal.

In preferred embodiments of the inventive imprinting method, signal strengths of frequencies within the useful signal, in particular the segment, are calculated and the imprinting frequencies are selected accordingly. This allows to determine frequencies or frequency ranges within the spectrum of the useful signal, which transport the highest signal strength or signal power. Embedding auxiliary data therein allows the watermark to be particularly transparent. Further, the signal waveform in regions with high power is not modified significantly when the signal is compressed (for example with the well known MP3 compression format).

In further embodiments of the inventive method, the first imprinting frequency and the second imprinting frequency are chosen from within a band with a narrow bandwidth compared to the spectrum of the useful signal, in particular with a bandwidth below 200 Hz, in particular below 100 Hz, for audio signals. The amplitudes of neighboring frequencies does not change significantly during transmission with most transmission channel frequency responses, if these follow usual requirements. Therefore, the amplitude ratio of imprinting frequencies which are nearby to each other is robust against transmission distortions.

The inventive method can be advantageously deployed if the useful signal is represented as a digital signal, for example a PCM-signal. In that case the imprinting of the amplitude ratio can easily be performed.

In further embodiments of the inventive imprinting method, the watermark bit sequence comprises one or more synchronization bit sequences for detection of the watermark bit sequence and an identifier bit sequence for identification of the useful signal. This allows for reliable detection of the watermark. Further, for encoding the identifier bit sequence in the watermark bit sequence, an error-protection code might be used, additionally protecting the identifier bit sequence, e.g. against transmission errors.

In particularly preferred embodiments, separate digital watermarks are imprinted onto the useful signal, in particular in separate bands. This allows to imprint different watermarks of, for example, author, publisher, and seller onto the original signal. Each watermark might still be imprinted several times, as imprinting in different frequency bands is carried out independently.

A method of detecting a digital watermark in a useful signal, in particular an audio signal, according to the invention comprises the features, that the useful signal represents the evolution of a spectrum comprising useful signal frequencies, for example audio frequencies, over time, and that the digital watermark is represented as a watermark bit sequence, each bit of the watermark bit sequence representing one of a first state, for example '1', and a second state, for example '0'. Further, according to this method, the ratio of a first spectral amplitude of the useful signal at a first imprinting frequency to a second spectral amplitude of the useful signal at a second imprinting frequency is calculated. In case the ratio is equal to or larger than 1, the first state is detected, otherwise the second state is detected. This allows to reliably detect a watermark imprinted to a useful signal according to the inventive method discussed further above.

In preferred embodiments of the detection method of the invention, a bit time length is established indicating a time length within which the state represented by a single bit is detected from the useful signal. For each bit time length, an indication of the detected state and a value of a ratio parameter is stored in association to each other in a detection bit sequence, wherein the ratio parameter indicates the value of the calculated ratio, if this value is equal to or larger than 1, and indicates the reciprocal value of the calculated ratio otherwise. This allows further processing of the detected bits and an estimation of their detection reliability.

In further developed embodiments, within the detection bit sequence, a search for an occurrence of a predetermined synchronization bit sequence is performed, and, if the occurrence is successfully detected, a search for an identifier bit sequence is performed.

In detail, the search for an occurrence of a predetermined synchronization bit sequence might comprise that matching bits between the detection sequence and the synchronization bit sequence are established and a prospective synchronization bit sequence comprising the matching bits is established. It might further comprise, that a first average ratio value of the values of the ratio parameters of that bits of the detection bit sequence underlying the prospective synchronization bit sequence is calculated.

The occurrence of the synchronization bit sequence is advantageously counted as successful detection, if the number of matching bits is at least the number of bits of the synchronization bit sequence minus 1, and the first average ratio value is larger than or equal to a predetermined threshold value.

It has been found practically advisable, in case the occurrence of the synchronization bit sequence is successfully detected, that the search is repeated close to the successfully matched bits of the detected bit sequence, whereby the repeated search is successful, if the number of matching bits is equal to the number of bits of the synchronization bit sequence. This further increases reliability of the detection process.

The search for an identifier bit sequence might comprise that a prospective identifier bit sequence is established using bits of the detected bit sequence following the bits of the detected bit sequence underlying the prospective synchronization bit sequence, a second average ratio value of the values of the ratio parameters of that bits of the detection bit sequence underlying the prospective identifier bit sequence is calculated.

Advantageously, if the second average ratio value is larger than a predetermined threshold, further prospective identifier bit sequences close to the successfully matched bits of the detected bit sequence are established and respective second average ratio values are calculated, and the identifier bit sequence is established as that one of the prospective identifier bit sequences with the highest average second average ratio value.

Further, for decoding the identifier bit sequence from the detected bit sequence, an error-protection code might be used.

To further increase reliability of the detection process, two detected identifier bit sequences are compared and an indication of successful detection of the identifier bit sequence is output if the two detected identifier bit sequences are identical.

In preferred embodiments of the detection method, in case the synchronization bit sequence is not detected in the detection bit sequence, the detection frequencies are shifted to neighbouring frequencies, with the difference between first and second detection frequency held constant, and the search for an occurrence of the synchronization bit sequence is repeated. Thus, it is possible to detect a watermark even if the frequencies of the useful signal have been shifted due to transmission errors or malicious attacks on the useful signal.

The aforementioned methods may be implemented on a computer program, which is adapted to run on a programmable computer, a programmable computer network or further programmable equipment. This allows cheap, easy and fast development of implementations of the inventive methods. In particular, such computer program might be stored on a computer-readable medium, as for example, CD-ROM or DVD-ROM.

Devices for use with the inventive methods may comprise in particular programmable computers, programmable computer networks or further programmable equipment, on which computer programs are installed, which implement the invention.

Figure 3:
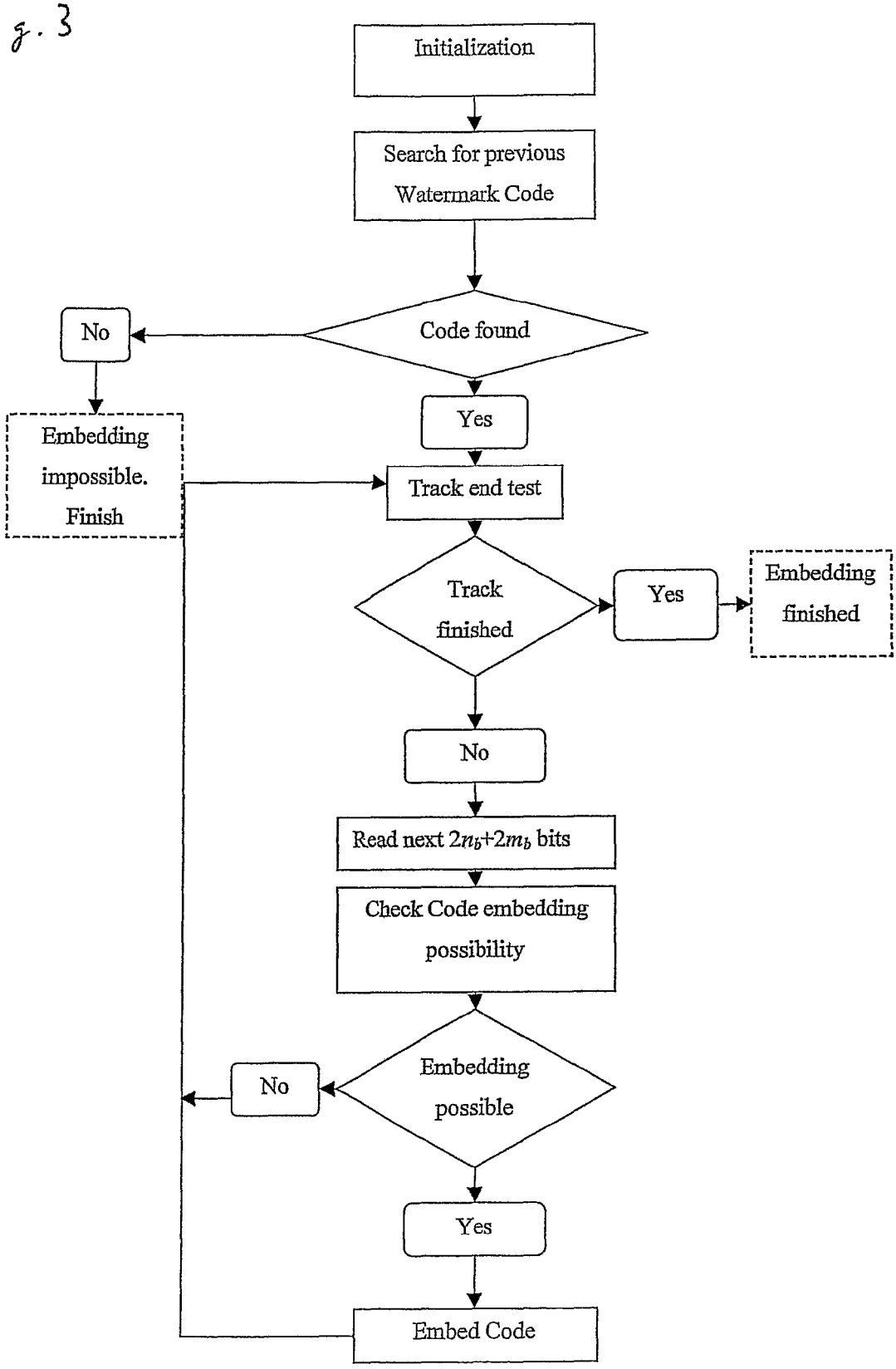
Figure 4A:
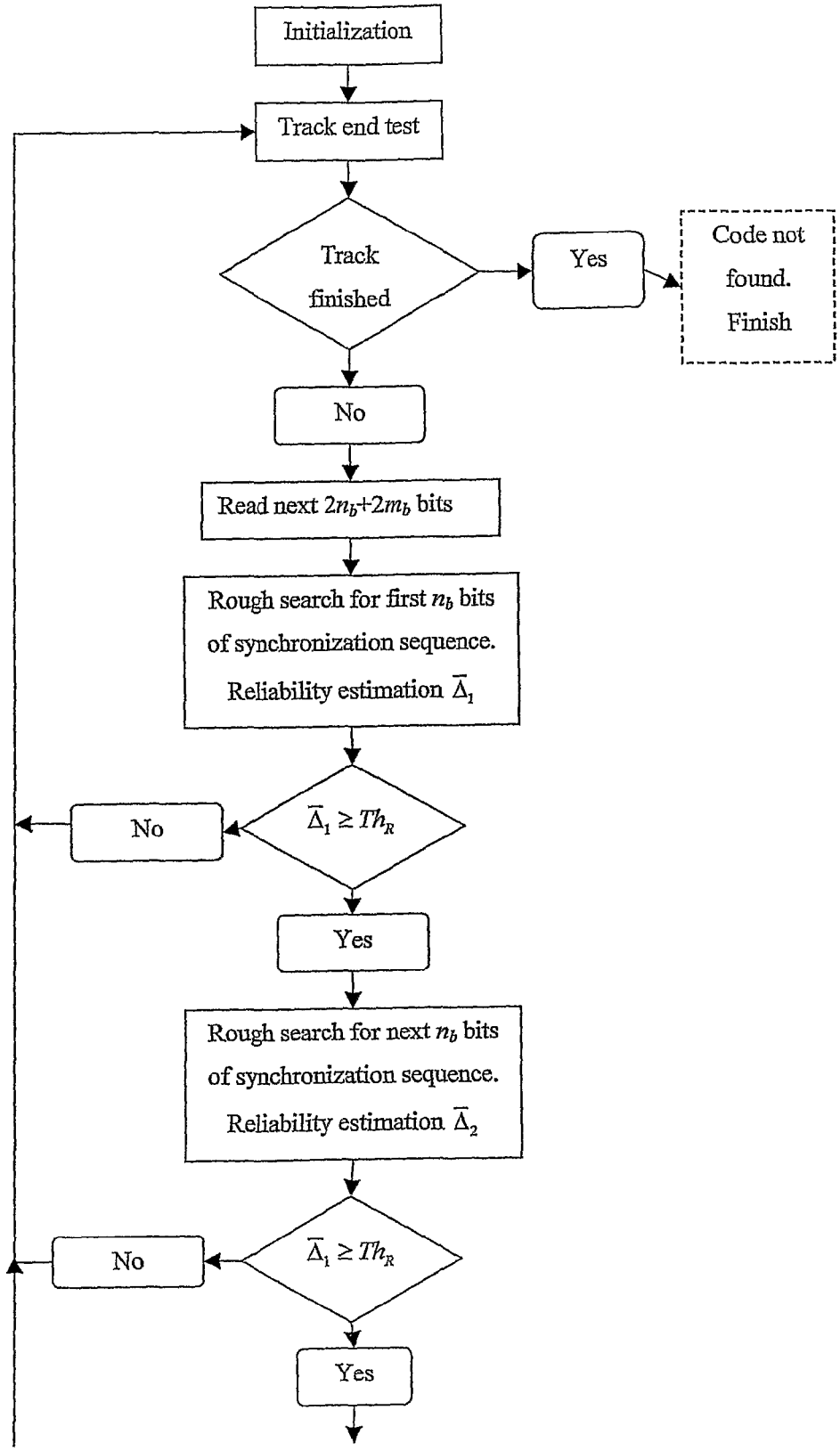
Figure 4B:
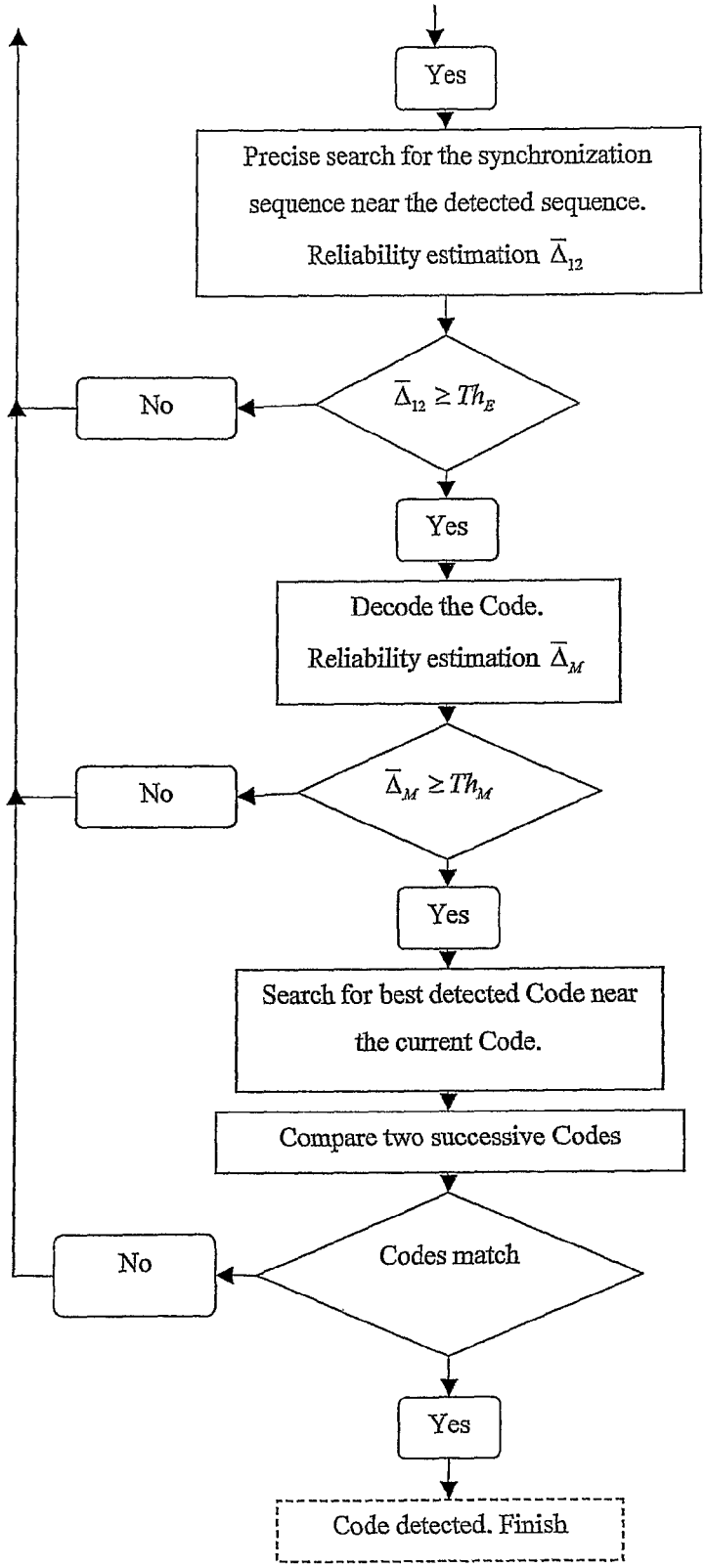
Figure 5:
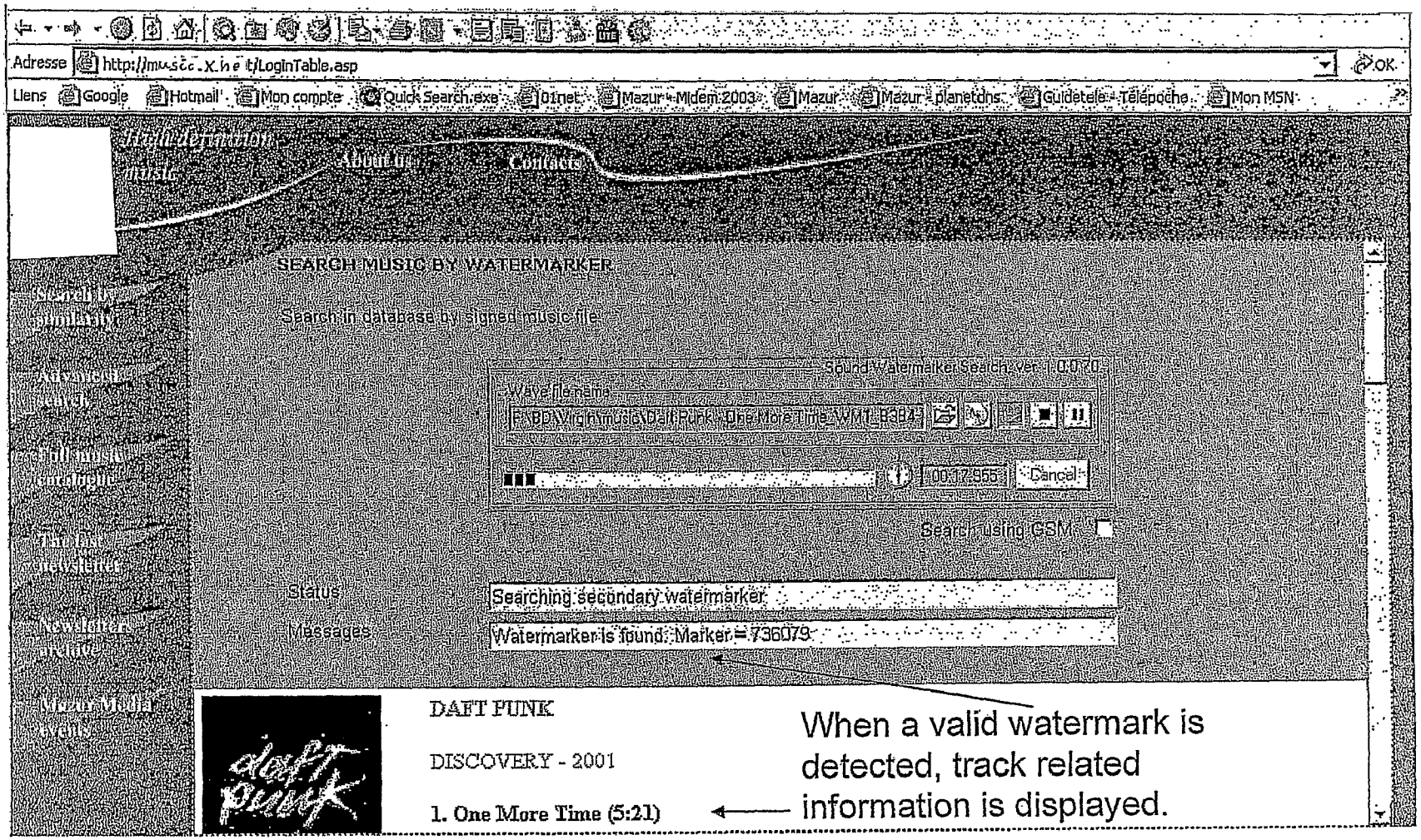

Further aspects and advantages of the invention will become apparent from the following description of embodiments of the invention with respect to the appended drawings, showing:

FIG. 1 a schematic representation of a bit sequence of a digital watermark according to the invention;

FIG. 2 three pairs of imprinting frequencies for imprinting three watermarks to a useful signal according to an embodiment of the invention;

FIG. 3 a flow diagram illustrating an embodiment of a method of imprinting a watermark according to the invention;

FIG. 4*a*, 4*b* a flow diagram illustrating an embodiment of a method of detecting a watermark according to the invention;

FIG. 5 a schematic example of a web page with an audio player having a watermark detection method according to the invention implemented.

A preferred embodiment of the inventive method of embedding a digital watermark in a useful signal basically comprises the following steps:

- generating a watermark bit sequence encoded as $2n_b$-bit fixed sequence and 2 $m_b$-bit random sequence;
- embedding a watermark bit sequence into the frequency domain of the useful signal using adaptive frequency modulation of two given frequencies by tracking amplitudes of the chosen frequencies of the original signal and modifying them according to the current bit of watermark bit sequence.

These steps are described in detail in the following sections 1) and 2).

1) Generation of a Watermark Bit Sequence

The useful signal into which the Seal Code is embedded should obtain a unique identifier. A binary sequence is generated by a random number generator and is used as identifier bit sequence with bit length $m_b$. Preferred values are 8 bits$\leqq m_b \leqq$32 bits, allowing to store from 256 to more than 4 billions of unique bit sequences in a database, and thus sign the same number of useful signals. The number of possible watermarks determined by $m_b$ can be defined by the operator of the watermarking system, for example a publishing company.

Within the abovementioned database, further fields can hold information related to the owner of the signal (i.e. an audio track) and/or for the end user. For example, the database includes the title of the musical composition, the name of its author, the name of the performer, the owner of the track (the publisher), etc.

Identifier bit sequences are generated in advance. A predefined list of unique identifiers is stored in the database, and an application program chooses one of the database entries on request and assigns values to further fields of that entry. Of course, it is also possible to generate identifiers on purpose.

The embodiment described in detail below embeds three watermarks in a useful signal. The length of the identifier binary sequence for the first watermark or seal code is $m_b$=32 bits, for the second and third seal codes is $m_b$=16 bits. Three seal codes allow to track the useful signal by three levels (e.g. owner, distributor, seller). Alternatively or in addition, three codes can be used to and/or increase reliability of the watermark detection by embedding the same watermark at two or three parallel levels.

To elaborate further on the above example, the three levels might be seen as being related to three levels of information, namely:

Level 1: Right owner and general product information;

Level 2: Digital Rights Management, Distribution, Licensing and Manufacturing information;

Level 3: Personal information (can be used to enter a recipient's name for a personalized CD-R).

The basic structure of the watermark, i.e. the watermark bit sequence, is illustrated in FIG. 1. The seal code begins with a fixed synchronization sequence of $2n_b$ bits, which is used for localization of the watermark during detection. The sequence of $2n_b$ bits is used as a secret key for friendly signal detection. Within the embodiment described here, a value $n_b$=15 is used. The synchronization sequence is followed by the identifier bit sequence, which is encoded using an error-correction code ($2m_b$, $m_b$). This code is capable of correcting single-bit errors and detecting double-bit errors. Thus, the length of the watermark bit sequence is $2n_b+2m_b$=94 bits in this embodiment. Of course, larger or smaller values for $n_b$ are also possible, leading to watermark bit sequences of different length.

The duration of a single bit $T_{bit}$, of the watermark bit sequence when embedded into the audio track, i.e. the useful signal, should in general satisfy the following inequality:

$$0.05 \text{ sec.} \leqq T_{bit} \leqq 0.2 \text{ sec.}$$

The exact value can be set by the user of the imprinting device. Thus, encoding the seal code one time requires a segment of the useful signal with a duration of $T_{code}$, and $$4.7 \text{ sec.} \leqq T_{code} \leqq 18.8 \text{ sec.}$$

The exact value depends on the value of $T_{bit}$ chosen. In general, these values of $T_{code}$ are short compared to prior art embedding methods. This is an important advantage of the invention, because it allows to embed the seal code several times within the full length of the useful signal. This in turn allows detection of the watermark in separate segments of the information signal. Further, the EBU recommends to set the length of a segment, within which a watermark is to be embedded, equal to 10 seconds. This recommendation can easily be satisfied using the invention.

The choice of exact values of the parameters $n_b$, $m_b$, and $T_{bit}$ depends on time and frequency properties of the useful signal onto which a watermark is to be imprinted. The above-described values of these parameters are optimum values for audio signals with most spectral energy density below 4000 Hz.

2) Modulating the Useful Signal

In the embodiment described here, the useful signal is processed on a computer. Thus, the useful signal is a sequence of samples $$x_n,\ n=0, 1, 2, \ldots, L-1$$

with sampling frequency $F_s$. As the useful signal is an audio signal, the sequence is stored and processed as a WAV-file, the structure of which is known to the skilled person.

Based on the watermark bit sequence described above, a watermark signal is formed. This signal is embedded according to the inventive imprinting method into the useful signal x, i.e. to an audio signal in a WAV-file. This procedure is described in detail in the following.

First, the useful signal is searched for a segment or segments, within which the watermark bit sequence can be embedded without perceptible changes. Thus, segments of length $T_{code}$ are identified with enough signal energy for masking the seal signal in time and frequency domain. In contrast with known methods, which operate to directly add a watermark signal to the useful signal in time or frequency domain, the method of the invention modifies fixed frequencies of the useful signal using adaptive frequency modulation.

In the example described here, three pairs of frequencies are chosen in a range from 400 to 2000 Hz, $$(f_1,g_1),(f_2,g_2),(f_3,g_3)$$

for three independent seal signals. The chosen frequency range contains the main part of the signal energy. Such principle of choice has the following advantages:

- It guarantees the required number of segments of length $T_{code}$) which allows embedding the seal signal with noise protection;
- The signal waveform is not modified significantly in this frequency range when the signal is compressed (e.g. using popular MP3 format).

The frequencies are chosen as illustrated in FIG. 2. Each pair of frequencies belongs to its own critical band. Frequencies are chosen to be multiples of $1/T_{bit}$, and differences between two frequencies of the same pair do not exceed 100 Hz. In other embodiments of the invention, the differences could be larger, but for reasons of reliable detection, the differences should preferably not exceed 200 Hz.

The inventive adaptive frequency modulation is described for one pair of frequencies, namely ($f_1$, $g_1$). The other pairs are processed correspondingly. The chosen segment of the useful signal is processed as a sequence of intervals with length $T_{bit}$. For each interval the in-phase and quadrature components of the signal are calculated:

$$A_{f_1}^c = \sum_{n=0}^{N-1} \cos\left(\frac{2\pi f_1}{F_S} n\right) x_n,\quad A_{f_1}^s = \sum_{n=0}^{N-1} \sin\left(\frac{2\pi f_1}{F_S} n\right) x_n$$

$$A_{g_1}^c = \sum_{n=0}^{N-1} \cos\left(\frac{2\pi g_1}{F_S} n\right) x_n,\quad A_{g_1}^s = \sum_{n=0}^{N-1} \sin\left(\frac{2\pi g_1}{F_S} n\right) x_n.$$

These two components are then used to calculate the spectral amplitudes of the useful signal at frequencies $f_1$, and $g_1$, according to the following equations:

$$A_{f_1} = \sqrt{A_{f_1}^{c2} + A_{f_1}^{c2}}, \tag{1}$$

$$A_{g_1} = \sqrt{A_{g_1}^{c2} + A_{g_1}^{s2}}. \tag{2}$$

Also the additional value $$r_1 = \frac{A_{f_1}}{A_{g_1}}$$

If the current bit to be encoded is '1' and $$r_1 \geqq \gamma_S,$$

then the original signal is left unmodified.

If, however, $$1 < r_1 < \gamma_S,$$

then the in-phase and quadrature components of $g_1$ are divided by $\lambda_s$. A new signal value is obtained according to the following formula:

$$y_n = x_n - \lambda_s\left(A_{g_1}^c \cos\left(\frac{2\pi g_1}{F_s} n\right) + A_{g_1}^s \sin\left(\frac{2\pi g_1}{F_s} n\right)\right).$$

Finally, if $$r_1 \leqq 1,$$

the in-phase and quadrature components of $g_1$ are replaced by new values, and a new signal value is generated according to formula:

$$y_n = x_n - (1 - \lambda_S r_1)\left(A_{g_1}^c \cos\left(\frac{2\pi g_1}{F_S} n\right) + A_{g_1}^s \sin\left(\frac{2\pi g_1}{F_S} n\right)\right)$$

Similarly, if the current bit to be encoded is '0', the in-phase and quadrature components of $f_1$, are modified depending on the ratio:

$$r_0 = \frac{A_{g_1}}{A_{f_1}}$$

The parameter values $$1<\gamma_S<10$$

and λ are set by the user. These parameters allow a trade-off between reliable masking and reliable detection of the seal signal of a certain class.

The amplitude ratio thus established does not change significantly due to transmission channel frequency response, if its properties satisfy the usual requirements, because the frequencies are close to each other. The inventive algorithm further includes an automatic frequency control system, which provides for additional protection against unintentional or intentional frequency shift. It is described below.

A device for embedding a digital watermark in a useful signal thus comprises a generator of auxiliary data, which generates an $m_b$-bit watermark bit sequence, which serves as an identifier for the useful signal (x). A random number generator or a predefined list of $2^{m_b}$ unique numbers can be used as a generator of auxiliary data. A $2n_b$-bit synchronization sequence is used as a secret key for friendly signal detection.

A reliable detection is advantageously facilitated by use of an error-correction code ($2m_b$, $m_b$). The $2m_b$-bit code follows the fixed $2n_b$-bit sequence, which allows precise determination of the Seal Signal. Thus, the watermark bit sequence comprises a binary sequence of $2n_b+2m_b$-bit length: a $2n_b$-bit synchronization bit sequence (fixed) and a $2m_b$-bit of error-correction code.

The embedding device further comprises a modulator, which encodes the watermark bit sequence into the useful signal (x). A segment of a useful signal of $(2n_b+2m_b)$ $T_{bit}$, seconds length should allow embedding a watermark bit sequence while maintaining the quality of the initial source signal and on the same time makes it difficult to detect the watermark bit sequence by hearing or visual inspection. The steps performed to prepare the embedding are illustrated in FIG. 3.

The modulator thus chooses a segment of the useful signal x, which can accommodate the watermark bit sequence without perceptible changes. Then the modulator encodes the watermark bit sequence sequentially by varying the amplitudes of two selected frequencies (f, g) in the spectrum of the useful signal (x). The pair of frequencies f, g might preferably be chosen in one critical band with a difference not exceeding 200 Hz and in the frequency region of maximum power density of the useful signal.

The amplitudes of the useful signal are calculated at frequencies f and g for the time interval $T_{bit}$, If the current bit is '1' and $A_f>A_g\gamma_S$, the original signal is left unchanged. Otherwise a new value $A_g=A_f/\gamma_S$ is calculated and the useful signal is modulated accordingly. Similarly, if the current bit is '0' and $A_g>A_f\gamma_S$, the original signal is left unchanged. Otherwise a new value $A_f=A_g/\gamma_S$ is calculated and the signal is modulated accordingly. The variable parameter $\gamma_S$ allows to mask the watermark bit sequence in the modified useful signal $\gamma_S$ in time and frequency domains.

Thus, a useful signal with embedded watermark bit sequence (y, see below) is generated. The identical watermark bit sequence might be repeated in the useful signal the same number of times as the number of identified suitable segments of x.

A preferred embodiment of the inventive method of detecting a digital watermark in a useful signal basically comprises the following steps:

- detection of a bit sequence by a double-channel frequency detector;
- search for the first $n_b$ bits in the output sequence of the frequency detector with reliability estimation;
- search For the next $n_b$ bits in the output sequence of the frequency detector with reliability estimation;
- detection and decoding of an $m_b$-bit identifier bit sequence with preset reliability.

These steps are discussed in detail in the following sections 3) and 4) and further illustrated in FIG. 4*a*, 4*b*.

3) Detecting a Watermark in the Useful Signal

A double-channel frequency detector is used for detection of the watermark bit sequence or seal code according to this embodiment of the invention.

The output of each channel is the amplitude of frequency $f_1$ or $g_1$, (FIG. 2), which are calculated on interval $T_{bit}$, by evaluating expressions identical to formulae (1), (2) from the previous section.

$$\hat{A}_{f_1}=\sqrt{\left[\sum_{n=0}^{N-1}\cos\left(\frac{2\pi f_1}{F_s}n\right)y_n\right]^2+\left[\sum_{n=0}^{N-1}\sin\left(\frac{2\pi f_1}{F_s}n\right)y_n\right]^2}, \tag{3}$$

$$\hat{A}_{g_1}=\sqrt{\left[\sum_{n=0}^{N-1}\cos\left(\frac{2\pi g_1}{F_s}n\right)y_n\right]^2+\left[\sum_{n=0}^{N-1}\sin\left(\frac{2\pi g_1}{F_s}n\right)y_n\right]^2}. \tag{4}$$

Here, $y_n$, is the useful signal with embedded Seal Signal. Then the detector calculates the ratio:

$$\Delta_i=\frac{\hat{A}_{f_1}}{\hat{A}_{g_1}}.$$

If we designate the sequence of detected bits as $$B_i,\ i=0,1,\ldots 2n_b+2m_b-1,$$

the value of the current bit would be:

$$B_i=\begin{cases}1, & \text{if } \Delta_i\geq 1\\ 0, & \text{if } \Delta_i<1.\end{cases}$$

In the second case the variable Δ is reassigned:

$$\Delta_i=\frac{1}{\Delta_i}.$$

The result of processing the input signal $y_n$ by the seal signal detector is a sequence of bits $\{B_i\}$ and a sequence of values $\{\Delta_i\}$. Both sequences are then fed to the input of the seal code search subsystem described below.

4) Searching for the Watermark Bit Sequence

The purpose of the seal code search subsystem is to detect a seal code, i.e. a watermark bit sequence with a structure as outlined in FIG. 1, in a bit sequence $\{B_i\}$ in real-time with high reliability. According to the embodiment of the invention discussed herein, the following steps are performed:

Step 1: A tough search for the first $n_b$ bits of a fixed synchronization sequence on $B_i$ is performed with a relatively large search step. For this the input bits from the detector are compared with $n_b$ bits of the synchronization sequence, stored in the system, and the sum of corresponding $\Delta_i$ values is calculated. If the number of matching bits is not less than $n_b-1$, an average value is calculated for estimating the reliability of match:

$$\overline{\Delta}_1 = \frac{1}{n_b}\sum_{i=0}^{N_b-1}\Delta_i \tag{5}$$

If this value exceeds a threshold:

$$\overline{\Delta}_1 \geqq Th_R,$$

the first $n_b$ bits of the synchronization sequence are considered to be detected, and the algorithm goes on to the next search step. Otherwise step 1 is repeated with a new sequence $B_i$.

Step 2: A rough search for the next $n_b$ bits of the synchronization sequence following the first $n_b$ bits is performed. The search is similar to step 1. A new average is calculated:

$$\overline{\Delta}_2 = \frac{1}{n_b}\sum_{i=n_b}^{2n_b-1}\Delta_i,$$

which for successful outcome should also exceed the same threshold:

$$\overline{\Delta}_2 \geqq Th_R.$$

If it does, the algorithm goes on to step 3. Otherwise, step 1 is repeated with new sequence $B_i$.

Step 3: A search with a decreased increment, i.e. a precise search of the $2n_b$ bits of the synchronization sequence close to the detected $2n_b$ bits is performed.

The synchronization sequence is considered to be detected if all of its bits match the fixed sequence, and the new average value $$\overline{\Delta}_{12} = \frac{1}{2n_b}\sum_{i=0}^{2n_b-1}\Delta_i$$

exceeds another threshold:

$$\overline{\Delta}_{12} \geqq Th_E.$$

If the synchronization sequence is not detected, the algorithm repeats step 1 with a new bit sequence.

It is important to note that the seal signal search subsystem according to the invention provides for real-time detection of the seal code with a false alarm probability of order $10^{-9}$ only. This is by an order of magnitude better than recommended by the EBU.

Step 4: An average value for the $2m_b$ bits of the Seal Code is calculated according to formula:

$$\overline{\Delta}_M = \frac{1}{2m_b}\sum_{i=2n_b}^{2n_b+2m_b-1}\Delta_i.$$

If it exceeds still another threshold $$\overline{\Delta}_M \geqq Th_M,$$

any seal code is searched near to the detected seal code, and the seal code with highest average $\overline{\Delta}_M$ is fed to the next step. Otherwise step 1 is repeated.

Step 5: The $2m_b$-bit sequence of error-correcting seal code is decoded into $m_b$ bits of decoded seal code. If any uncorrectable errors are discovered, step 1 is repeated.

Step 6: Two successively detected seal codes are compared with each other to provide increased reliability. If the bit sequence turns out to be identical, it is considered to be a successfully detected seal code or watermark bit sequence. Otherwise the algorithm returns to step 1 to find another segment with a seal code.

Steps 4-6 guarantee correct detection of the seal code with high reliability. If the useful signal is not long enough for step 6 to be carried out, the search is finished after step 5. In this case any errors discovered in the error-correction code leads to the determination, that the seal code, if any has been imprinted, has not been found.

A device for detecting a watermark in a useful signal thus comprises a detector, which processes a useful signal with possibly embedded watermark bit sequence. The detector calculates the amplitudes of two selected frequencies and determines the occurrence of logical states '1' or '0' by detecting the ratio Δ of these frequencies. The calculated ratios Δ are used for estimating the watermark bit sequence detection reliability.

The detector further comprises a search module, which searches for the $m_b$-bit watermark bit sequence in a detected sequence of logical '1'-s and '0'-s. The amplitudes f and g of the signal y are calculated sequentially at intervals $T_{bit}$, together with their ratio, which leads to the corresponding logical value of '0' or '1'. The amplitude ratios on the whole segment $(2n_b+2m_b)\ T_{bit}$, are added together and used for estimation of the watermark bit sequence search reliability.

The module first searches for the first $n_b$ bits of a synchronization bit sequence with (k)-bit step, until the module has identified $n_b$-$\Delta_b$ correct bits with average value of $\overline{\Delta}$ being above a threshold $Tb_R$. It then searches for the next $n_b$ bits of the synchronization sequence. Then the search module determines the position of a $2n_b$-bit synchronization sequence more precisely by decreasing the search step down to 1-2 samples. Then the module calculates the $2m_b$ bits of error-correction code, estimates its reliability by the average value of corresponding A values and finally decodes a Mb-bit watermark bit sequence out of the $2m_b$-bit sequence.

The invention allows to detect the $2m_b$ watermark bit sequence in the detected bit sequence in real-time (e.g. while listening to an audio file). The first $n_b$ bits of the fixed synchronization sequence are searched until a matching sequence is detected with reliability estimate exceeding a certain threshold. Then the next $n_b$ bits are searched directly after the first $n_b$ bits. If these are not detected, the next segment is searched. After the full synchronization sequence of $2n_b$ bits is detected, the next $2m_b$ bits are interpreted as a identifier bit sequence with some reliability estimate, which should exceed another threshold, in which case the $2m_b$ bits of error-correction code are decoded into $m_b$ bits of identifier code. Otherwise the search is repeated starting from the next segment. Such iterative procedure reduces the probability of false detection of the watermark bit sequence to very low values.

A high reliability of detection and prevention of false detection might additionally be provided by considering the watermark bit sequence as detected only if two successively detected watermark bit sequences are identical to each other. Otherwise the search is continued. If the length of the useful signal does not allow to detect two successive watermark bit sequences, preferably the watermark bit sequence is considered to be found if the decoder does not find any errors, otherwise the watermark bit sequence is considered to be missing.

The invention allows to embed and detect more than one, for example three independent watermarks by choosing more than one, for example three pairs of frequency in the useful signal spectrum.

Optional Automatic Frequency Control

The automatic frequency control system of the invention provides protection against unintentional or intentional frequency shift in the useful signal spectrum.

If the first $n_b$-$\delta_b$ bits are not detected in the first $n_s$ searched segments, and the search quality is below a preset threshold, the automatic frequency control for frequencies ($f_1$, $g_1$) is turned on.

New base frequencies ($f_1$, $g_1$) are sought or established as $$\begin{cases} \tilde{f}_1 = f_1 + \delta_f k \\ \tilde{g}_1 = g_1 + \delta_f k \end{cases}, \text{ where } -15 \le k \le 15,\ \delta_f = 2 \text{ Hz}$$

If |k|>15, the useful signal is distorted significantly.

The segment is searched for the first $n_b$-$\delta_b$ bits for each pair of ($\tilde{f}_1$, $\tilde{g}_1$). If correct $n_b$-$\delta_b$ bits are detected, the new base frequencies are fixed, thus the search for the seal code is continued at these frequencies.

$$\begin{cases} f_1 = f_1 + \delta_f k^* \\ g_1 = g_1 + \delta_f k^* \end{cases}$$

In preferred embodiments of the invention, the imprinting and the detecting methods may be implemented in software, hardware or both. Each method or parts thereof may be described with the aid of appropriate programming languages in the form of computer-readable instructions, such as program or program modules. These computer programs may be installed on and executed by one or more computers or such like programmable devices. The programs may be stored on removable media (CD-ROMs, DVD-ROMs, etc.) or other storage devices, for storage and distribution purposes or may be distributed via the internet.

Devices implementing the inventive detecting method may be audio player tools for use on a PC. These players might be dedicated hardware with appropriate software, i.e. stand-alone-player, or may be activated on a desktop display of a PC, integrated in a web page or downloaded and installed as a plug-in to execute in known players.

As an example, FIG. 6 illustrates a web player having the inventive watermark detection method implemented. Upon request of a user, the player starts playing the requested track and searches for watermarks within the useful signal. The screen shot of FIG. 6 illustrates a status 18 seconds after the track processing has started, where already a first watermark has been successfully detected and related information is displayed to the user.

On detection of a watermark the player might display dependent on configuration indications related to the detection, for example a simple message 'Watermark is found', and/or displays part or all of the watermark information and/or performs further operations. As an example, the player might access via the internet a database for the purpose of receiving and displaying further information related to the watermarked primary data (not shown in FIG. 6). Alternatively or additionally the player might access web pages related to the primary data.

Some appropriate embodiments of the invention have been described herein. Many further embodiments are possible, and are evident to the skilled person, without departing from the scope of the invention, which is exclusively defined by the appended claims.

The invention claimed is:

1. Method of embedding a digital watermark in a useful signal, in particular an audio signal, using one of a programmable computer, a programmable computer network, and a further programmable equipment, wherein the useful signal ($x_n$) represents the evolution of a spectrum comprising useful signal frequencies, over time, and the digital watermark includes a watermark bit sequence, each bit of the watermark bit sequence representing one of a first state and a second state, characterized in that for imprinting the first state on the useful signal, the ratio of a first spectral amplitude ($A_f$) of the useful signal at a first imprinting frequency ($f_1$) to a second spectral amplitude ($A_g$) of the useful signal at a second imprinting frequency ($g_1$) is established to be higher or equal to a first value of a threshold parameter ($y_s$), and for imprinting the second state, the ratio of the second spectral amplitude ($A_g$) of the useful signal at the second imprinting frequency ($g_1$) to a first spectral amplitude ($A_f$) of the useful signal at a first imprinting frequency ($f_1$) is established to be higher or equal to a second value of the threshold parameter ($y_s$), forming the digital watermark containing auxiliary data, and embedding the digital watermark in the useful signal to generate a modulated useful signal incorporating the auxiliary data, characterized in that for imprinting the first state, the corresponding ratio is adjusted by decreasing the second spectral amplitude ($A_g$), and for imprinting the second state, the corresponding ratio is adjusted by decreasing the first spectral amplitude ($A_f$).

2. Method of embedding a digital watermark in a useful signal, in particular an audio signal, using one of a programmable computer, a programmable computer network, and a further programmable equipment, wherein the useful signal ($x_n$) represents the evolution of a spectrum comprising useful signal frequencies, over time, and the digital watermark includes a watermark bit sequence, each bit of the watermark bit sequence representing one of a first state and a second state, characterized in that for imprinting the first state on the useful signal, the ratio of a first spectral amplitude ($A_f$) of the useful signal at a first imprinting frequency ($f_1$) to a second spectral amplitude ($A_g$) of the useful signal at a second imprinting frequency ($g_1$) is established to be higher or equal to a first value of a threshold parameter ($y_s$), and for imprinting the second state, the ratio of the second spectral amplitude ($A_g$) of the useful signal at the second imprinting frequency ($g_1$)to a first spectral aplitude ($A_f$)of the useful signal at a first imprinting frequency ($f_1$) is established to be higher or equal to a second value of the threshold parameter ($y_s$) forming the digital watermark containing auxiliary data, and embedding the digital watermark in the useful signal to generate a modulated useful signal incorporating the auxiliary data, characterized in that a bit time length ($T_{bit}$) is established indicating a time length within which the state represented by a single bit is imprinted to the useful signal, a segment time length ($T_{code}$) is calculated, using the number of bits of the watermark bit sequence and the bit time length, indicating the time length within which the watermark bit sequence is imprinted to the useful signal, a segment of the useful signal with a time length of at least a segment time length is selected to imprint the watermark bit sequence.

3. Method according to claim 2, characterized in that two or more non-overlapping segments are selected to imprint the watermark bit sequence two or more times to the useful signal.

4. Method according to claim 1, characterized in that the first imprinting frequency and the second imprinting frequency are chosen from within a band with a narrow bandwidth compared to the spectrum of the useful signal, in particular with a bandwidth equal to or below 200 Hz, in particular equal to or below 100 Hz, for audio signals.

5. Method according to claim 1, characterized in that the useful signal is represented as a digital signal.

6. Method according to claim 1, characterized in that the watermark bit sequence comprises at least one synchronization bit sequence for detection of the watermark bit sequence and an identifier bit sequence for identification of the useful signal.

7. Method according to claim 6, characterized in that for encoding the identifier bit sequence in the watermark bit sequence, an error-protection code is used.

8. Method according to claim 1, characterized in that separate digital watermarks are imprinted onto the useful signal, in particular in separate bands.

9. Method of detecting a digital watermark in a useful signal, using one of a programmable computer, a programmable computer network, and a further programmable equipment, wherein the useful signal (y) represents the evolution of a spectrum comprising useful signal frequencies, over time, and the digital watermark is represented as a watermark bit sequence, each bit of the watermark bit sequence representing one of a first state and a second state, characterized in that the ratio of a first spectral amplitude ($\hat{A}_f$) of the useful signal at a first detection frequency ($f_1$) to a second spectral amplitude ($\hat{A}_g$) of the useful signal at a second detection frequency ($g_1$) is calculated, and in case the ratio ($\Delta_i$) is equal to or larger than 1, the first state is detected, otherwise the second state is detected, processing the useful signal to detect the digital watermark, and indicating when the digital watermark has been found, characterized in that a bit time length ($T_{bit}$) is established indicating a time length, within which the state represented by a single bit is detected from the useful signal, for each bit time length, an indication of the detected state ($B_i$) and a value of a ratio parameter ($\Delta_i$) is stored in association to each other in a detection bit sequence, wherein the ratio parameter indicates the value of the calculated ratio, if this value is equal to or larger than 1, and indicates the reciprocal value of the calculated ratio otherwise.

10. Method according to claim 9, characterized in that within the detection bit sequence, a search for an occurrence of a predetermined synchronization bit sequence is performed, and, if the occurrence is successfully detected, a search for an identifier bit sequence is performed.

11. Method according to claim 10, characterized in that the search for an occurrence of a predetermined synchronization bit sequence comprises that matching bits between the detection sequence and the synchronization bit sequence are established and a prospective synchronization bit sequence comprising the matching bits is established, and a first average ratio value ($\overline{\Delta}_1$) of the values of the ratio parameters of that bits of the detection bit sequence underlying the prospective synchronization bit sequence is calculated.

12. Method according to claim 11, characterized in that the occurrence of the synchronization bit sequence is successfully detected, if the number of matching bits is at least the number of bits of the synchronization. bit sequence minus 1, and the first average ratio value is larger than or equal to a predetermined threshold value ($Th_r$).

13. Method according to claim 12, characterized in that in case the occurrence of the synchronization bit sequence is successfully detected, the search is repeated close to the successfully matched bits of the detected bit sequence, whereby the repeated search is successful, if the number of matching bits is equal to the number of bits of the synchronization bit sequence.

14. Method according to claim 13, characterized in that the search for an identifier bit sequence comprises that a prospective identifier bit sequence is established using bits of detected bit sequence following the bits of the detected bit sequence underlying the prospective synchronization bit sequence, a second average ratio value ($\overline{\Delta}_M$) of the values of the ratio parameters of that bits of the detection bit sequence underlying the prospective identifier bit sequence is calculated.

15. Method according to claim 14, characterized in that if the second average ratio value is larger than a predetermined threshold ($Th_M$), further prospective identifier bit sequences close to the successfully matched bits of the detected bit sequence ate established and respective second average ratio values are calculated, and the identifier bit sequence is established as that one of the prospective identifier bit sequences with the least average second average ratio value.

16. Method according to claim 15, characterized in that for decoding the identifier bit sequence from the detected bit sequence, an error-protection code is used.

17. Method according to claim 16, characterized in that two detected identifier bit sequences are compared and an indication of successful detection of the identifier bit sequence is output if the two detected identifier bit sequences are identical.

18. Method according to claim 17, characterized in that in case the synchronization bit sequence is not detected in the detection bit sequence, the detection frequencies are shifted to neighboring frequencies ($\overline{f}_1$, $\overline{g}_1$), with the difference between first and second detection frequency held constant, and the search for an occurrence of the synchronization bit sequence is repeated.

* * * * *